United States Patent [19]

Ehrenfield

[11] Patent Number: 4,848,737

[45] Date of Patent: Jul. 18, 1989

[54] CARDIOVASCULAR EXERCISE LADDER

[76] Inventor: Ted. R. Ehrenfield, 175 Queensbury Ct., Newport News, Va. 23602

[21] Appl. No.: 104,282

[22] Filed: Oct. 1, 1987

[51] Int. Cl.[4] ..... A63B 23/06; A63B 7/04

[52] U.S. Cl. ..... 272/70; 272/69; 272/112

[58] Field of Search ..... 272/112, 69, 70, 73, 272/129, DIG. 6, 93, 120, 131, 132, 133; 182/37, 43

[56] References Cited

U.S. PATENT DOCUMENTS

| | | | |
|---|---|---|---|
| 2,042,764 | 6/1936 | Birch . | |
| 3,497,215 | 2/1970 | Harrison et al. . | |
| 3,518,985 | 7/1970 | Quinton . | |
| 3,572,700 | 3/1971 | Mastropaolo | 272/129 |
| 3,592,446 | 7/1971 | Parsons . | |
| 3,731,917 | 5/1973 | Townsend . | |
| 3,869,121 | 3/1975 | Flavell | 272/129 |
| 3,870,297 | 3/1975 | Elder | 272/69 |
| 4,278,095 | 7/1981 | Lapeyre . | |
| 4,378,111 | 3/1983 | Tsuchida et al. | 272/73 |
| 4,529,194 | 7/1985 | Haaheim . | |
| 4,555,108 | 11/1985 | Monteiro . | |
| 4,577,862 | 3/1986 | Sagedahl | 272/129 |

FOREIGN PATENT DOCUMENTS

| | | | |
|---|---|---|---|
| 2006887 | 9/1971 | Fed. Rep. of Germany | 272/112 |
| 3502127 | 7/1986 | Fed. Rep. of Germany | 272/69 |
| 3502132 | 7/1986 | Fed. Rep. of Germany . | |
| 1227215 | 4/1986 | U.S.S.R. | 272/69 |
| 1245324 | 7/1986 | U.S.S.R. . | |
| 2010101 | 6/1979 | United Kingdom . | |

*Primary Examiner*—S. R. Crow

*Attorney, Agent, or Firm*—Raymond L. Greene

[57] ABSTRACT

The invention is a moving ladder exercise device 10 comprising a base 11, moving ladder assembly 12 and retarder assembly 14 using a microprocessor 15 to control retarder speed. The operation of the moving ladder requires the operator to climb the ladder thereby driving the ladder with his body weight. Maximum speed of the ladder assembly 12 cannot exceed the speed of the retarder assembly 14 due to the unidirectional clutch 33 and worm-drive assembly 32. Sensors 17 monitor heart rate of the operator and sensor 16 monitors ladder speed. Sensor output to microprocessor 15 provides feedback which allows the microprocessor to adjust retarder assembly speed so that the desired heart rate is reached and maintained.

1 Claim, 4 Drawing Sheets

CARDIOVASCULAR EXERCISE LADDER

TECHNICAL FIELD OF THE INVENTION

The invention is related to the field of exercise equipment and more particularly to treadmill and moving ladder devices.

BACKGROUND OF THE INVENTION

A variety of cardiovascular exercise devices have been developed which allow the user to perform walking, running and climbing exercises. These devices include treadmills, escalator-type devices, and moving ladders. The majority of the devices exercise predominately the legs. The most common device of this type is a treadmill, either powered or unpowered.

Another less common type is the moving stair or moving ladder device. This device also is predominately a leg exerciser providing very little upper body exercise. Devices which do provide upper body work such as bench press machines, generally do not provide good cardiovascular training results. Attempts to create good cardiovascular effects while using upper body exercisers also have produced a series of cross-country skiing simulators. These devices can provide a good balance in upper and lower body exercise while also providing good cardiovascular exercise. The main drawback is the relative complexity of these machines and the restricted capability to adjust the workload between upper and lower body muscles.

Accordingly, it is an object of the present invention to provide a means to produce cardiovascular training effects while exercising upper body muscles.

It is another object of the present invention to provide cardiovascular effects while minimizing impact shocks to the knees and legs.

It is yet another object of the present invention to provide means for maintaining operator heart rate in a predetermined range.

Another object of the present invention is to provide the operator with an accurate readout of calories expended based on work output to the device.

It is still another object of the present invention to provide a means of shifting workload between upper and lower body muscles as necessary for the desired training effect.

It is still another object of the present invention to provide a moving ladder apparatus capable of operating at variable speeds.

It is a further object of the present invention to provide a means of speed control for a moving ladder exercise apparatus.

It is still a further object of the present invention to provide a means of stopping the moving ladder immediately if the operator fails to remove his foot from the mechanism or otherwise discontinues his exercise.

SUMMARY OF THE INVENTION

According to the present invention, the foregoing and additional objects are attained by providing a cardiovascular exercise ladder having an adjustable inclination angle and having an electrically driven retarder device to prevent overspeed and to allow immediate stopping of the ladder whenever the exerciser stops. The invention comprises a base unit providing a mounting platform, a moving ladder assembly, retarder mechanism, to control ladder speed, a speed sensor and a microprocessor to control the retarder mechanism. The moving ladder assembly comprises cross-rungs mounted on drive chains such that when the operator boards the exercise ladder his body weight drives the rungs downward. The maximum speed of the ladder is retarded by a retarder mechanism comprising an electric motor and worm drive gear assembly operating with a unidirectional drive clutch. The gear assembly prevents the ladder speed from exceeding the speed of the electric motor. When the ladder speed drops below the motor speed, the motor continues to turn but imparts no driving or retarding force to the ladder. This unidirectional drive feature allows the operator to stop exercise at any time without danger of entanglement in the machinery. The speed of the electric motor-retarder mechanism is controlled by a microprocessor which adjusts the ladder speed so that the desired heart rate is achieved and maintained. Sensors are attached to the ladder supports to monitor ladder speed and to the operator to monitor heart rate. The inclination angle of the ladder adjusts from 45 degrees through vertical to 135 degrees. By adjusting the angle and speed of the ladder, it is possible to set a wide range of work rates and, also, to shift the major effort to the upper or lower body muscle groups.

BRIEF DESCRIPTION OF THE DRAWINGS

A more complete appreciation of the present invention and the many attendant advantages thereof will be readily apparent as the same becomes better understood by reference to the following description when considered in connection with the accompanying drawings wherein.

DETAILED DESCRIPTION OF THE INVENTION

Figure 1:
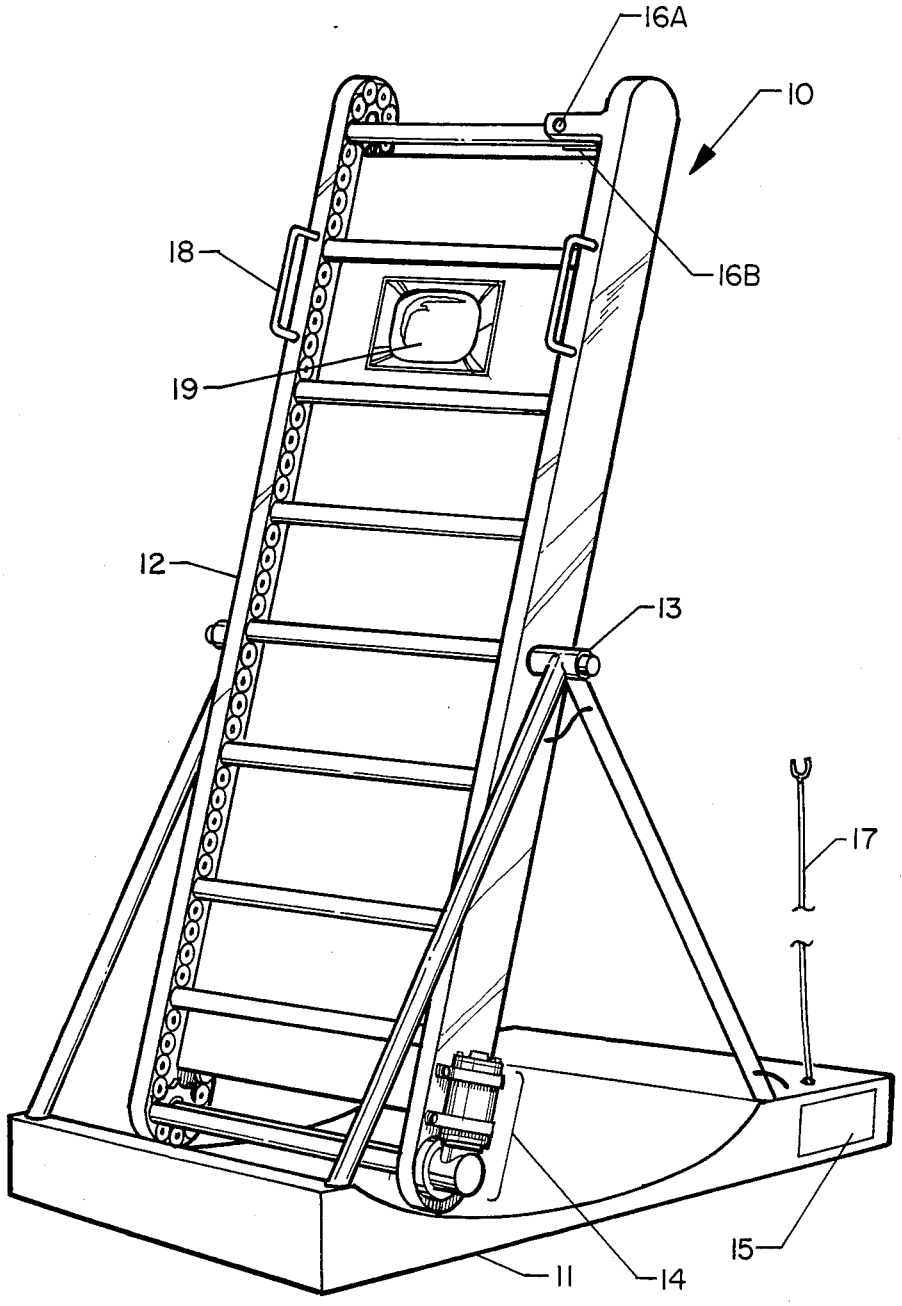
FIG. 1 is a perspective view of the cardiovascular exercise ladder.

Referring now to the drawings wherein the same element is referred to by the same reference numeral throughout the several views and more particularly to FIG. 1, a perspective view depicts the overall combination of the present invention designated generally by the numeral 10. The invention is assembled on a base 11 which serves as a mount for the moving ladder assembly 12 and also as a platform for standing if the operator intends to perform arm-only exercises. A pivot 13 allows adjustment of the ladder inclination angle to vary workload and to vary upper-lower body stress balance. A retarder assembly 14 controls the speed of the moving ladder using a combination of electric motor, worm-drive gear and unidirectional clutch. A microprocessor 15 controls the speed of the retarder assembly using a speed sensor 16*a* and *b* for input data. Heart sensor 17 is also connected to microprocessor 15 to provide feedback on heart response. In the event that leg-only exercise is desired, handgrips 18 provide for minimal upper-body stress. Visual display of microprocessor data such as heart rate, rung speed and other data are displayed on panel 19.

Figure 2:
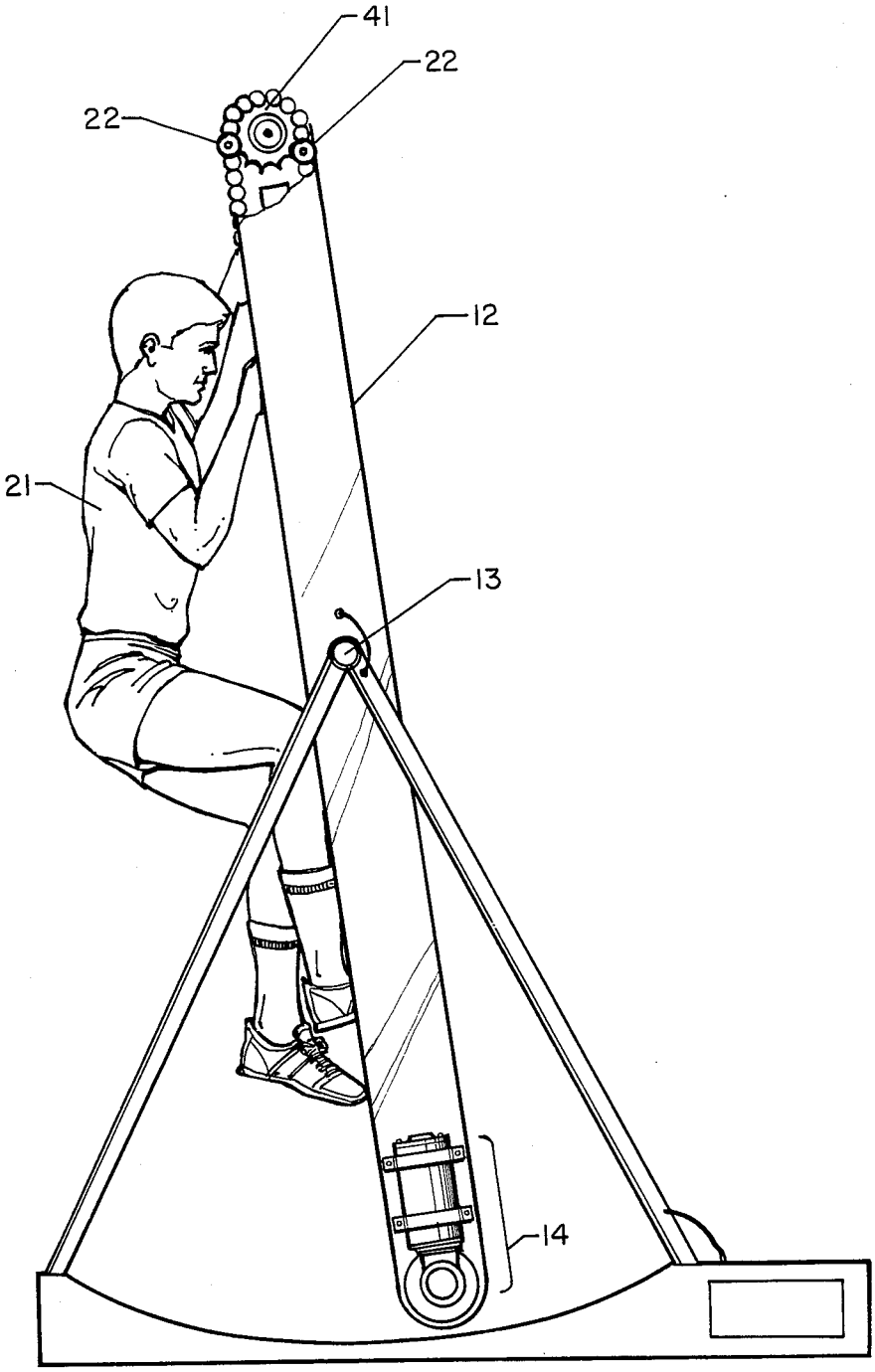
FIG. 2 is a side view of the exercise ladder showing the inclination angle adjustment feature.

Referring now to FIG. 2, a side view showing the ladder assembly 12 rotated on pivot 13 past the vertical to an inclination angle which causes the operator 21 to hang from the underside of the assembly. In this mode of operation, the operator must raise his body to rung 22 primarily through the use of arm muscles. Leg muscles, however, also provide some lifting power resulting in a lower stress load than that experienced in a standard pull-up. The speed of the motion is controlled by setting the speed of retarder device 14 in the same manner as in upright operation. Useful angles appear to lie between 45 degrees and 135 degrees, that is 45 degrees either side of vertical.

Figure 3:
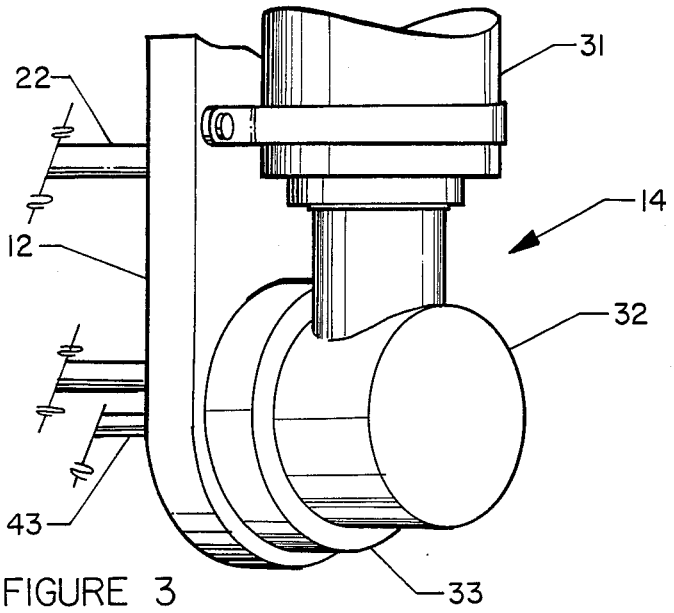
FIG. 3 is a perspective view of the retarder mechanism shown installed on the ladder.

Referring to FIG. 3, a perspective view of the installed retarder device 14 shows the components: an electric motor 31, drive shaft 43 and worm gear assembly 32, and clutch mechanism 33, installed on moving ladder device 12. Clutch 33 is configured such that drive impulse can be transferred from the moving ladder to the gear drive assembly but cannot be transferred from the motor to the ladder assembly. When the motor speed exceeds ladder speed, the unidirectional clutch merely disengages. A cutaway view, shown in FIG. 4, of the motor-gear-clutch assembly will show the complementary operation of the worm drive and unidirectional clutch.

Figure 4:
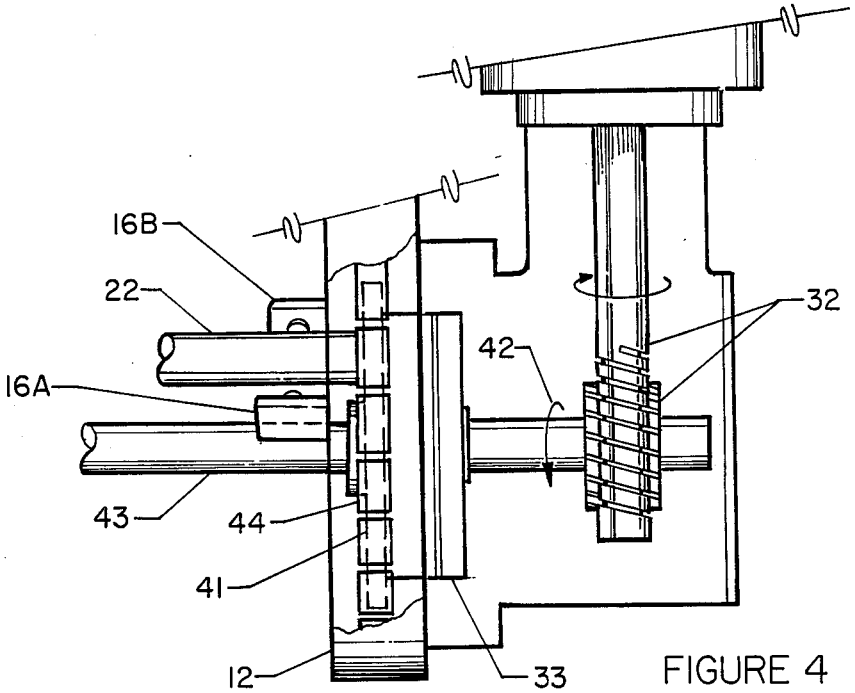
FIG. 4 is a partial cutaway view of the retarder mechanism comprising an electric motor worm drive-clutch assembly.

Referring now to FIG. 4, a perspective view of the elements of the retarder assembly shows the chain drive sprocket 41 is forced by operator weight to rotate as shown by arrow 42. Unidirectional clutch 33 locks thereby transmitting torque into worm gear mechanism 32. However, no feed through to electric motor 31 can occur since the worm drive isolates the motor from the driving force. When rotation of the ladder sprocket 41 stops or drops below the speed of the worm drive output, then clutch 33 disengages so that the motion depicted by arrow 42 cannot be transmitted to the ladder. By these means, the moving ladder is powered only by operator weight and never by the electric motor-worm drive assembly. Ladder speed is monitored by the microprocessor using infrared beam 16A and photocell 16*b* to count passage of rungs 22. Shaft 43 connects both sides of the moving ladder and is driven by chains 44.

Figure 5:
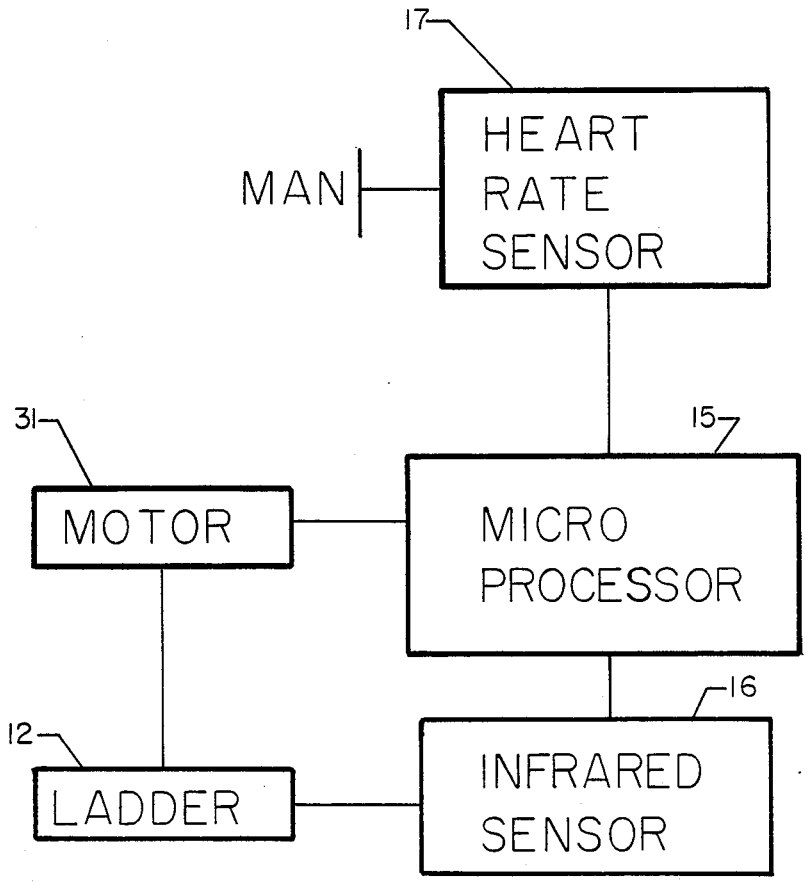
FIG. 5 is a schematic of the microprocessor control unit with the speed and heart rate sensors.

Referring now to FIG. 5, a schematic of the microprocessor and sensors and display is depicted. Microprocessor 15 monitors operator heart rate through heart rate sensor 17 and monitors ladder speed through infrared sensor 16. Based on an algorithm set up to cause incremental speed changes at ten second intervals, microprocessor 15 varies the speed of electric motor 31 to attain the desired heart rate. Safety is achieved without microprocessor control because there is no drive input to the moving ladder.

Operation of the Invention

The invention is ready to operate once the electric motor in the retarder assembly is operating. A complete range of stress levels is available for both upper and lower body muscle groups by changing ladder inclination angle and by using the platform or the handgrips. For example, a minimum effort arm-only exercise may be accomplished by standing on the base platform pulling the rungs downward at a moderate rate. A maximum effort arm-only or predominately arm exercise may be accomplished by rotating the ladder through the vertical to an inclination angle which provides an inverted climbing position. In this position, arm loads will be very high. Likewise, leg only exercises may be conducted by holding the handgrips and walking up the ladder at a variety of angles. Simultaneous upper and lower body workouts can be accomplished by climbing the ladder in the conventional fashion using both arms and legs while the ladder is positioned at an inclination angle of 60 to 70 degrees.

Although the invention has been described relative to a specific embodiment thereof, it is not so limited and numerous variations and modifications thereof will be readily apparent to those skilled in the art in light of the above teachings. It is therefore to be understood that within the scope of the appended claims, the invention may be practiced otherwise than as specifically claimed herein.

What is claimed as new and desired to be secured by Letters Patent of the United States is:

1. A moving cardiovascular exercise ladder capable of distributing workload between upper body and lower body muscle groups and comprising in combination:

a base support platform;

a low-friction, moving ladder assembly having a closed-loop transmission, said assembly mounted on said base support platform, and being freerunning, independent of any frictional, hydraulic, or electrical drag devices, below a selectable limiting speed;

a moving retarder means comprising an electric motor, worm gear drive mechanism, and unidirectional clutch, said retarder means functioning so that said clutch engages and connects the retarder means to the moving ladder assembly thereby limiting the ladder speed to a selected value, said ladder assembly incorporating a pivotal mount attached to said base support platform such that adjustments may be made in the inclination angle of the ladder;

a microprocessor attached to the fixed structure of said moving ladder assembly;

a ladder speed sensor functionally connected to said microprocessor; and a heart rate sensor for monitoring the heart rate of the operator functionally connected to said microprocessor.

* * * * *